United States Patent [19]

Robertson

[11] Patent Number: 5,005,812

[45] Date of Patent: Apr. 9, 1991

[54] PNEUMATIC BEARING JACK AND ADAPTORS

[76] Inventor: M. D. Robertson, Rte. 1, Box 456, Big Spring, Tex. 79720

[21] Appl. No.: 412,015

[22] Filed: Sep. 25, 1989

[51] Int. Cl.[5] ..... B66F 3/00

[52] U.S. Cl. ..... 269/47; 254/93 R; 254/133 R; 29/252

[58] Field of Search ..... 254/133, 134, 93 R, 254/93 H, 100, DIG. 4; 269/47, 17; 29/252

[56] References Cited

U.S. PATENT DOCUMENTS

| | | | |
|---|---|---|---|
| 652,424 | 6/1900 | Callegari . | |
| 908,210 | 12/1908 | Crystal . | |
| 1,504,931 | 8/1924 | Blasezyk | 269/47 |
| 1,603,933 | 10/1926 | Baldwin | 269/47 |
| 1,609,103 | 11/1926 | Baldwin | 269/47 |
| 1,796,173 | 3/1931 | Warren . | |
| 2,215,146 | 9/1940 | Compano . | |
| 2,568,827 | 9/1951 | Schallock | 254/133 R |
| 2,885,165 | 5/1959 | Smolen | 269/47 |
| 3,730,481 | 5/1973 | Ekonen et al. | 254/93 R |
| 3,830,470 | 8/1974 | Gibson . | |
| 4,140,306 | 2/1979 | Wheeler | 269/47 |
| 4,491,305 | 1/1985 | Walters | 269/47 |
| 4,640,495 | 2/1987 | Parsons . | |
| 4,811,931 | 3/1989 | Bandy . | |

*Primary Examiner*—Robert C. Watson
*Attorney, Agent, or Firm*—Marcus L. Bates

[57] ABSTRACT

A jack and adaptor combination for use in lifting the journaled end of a piston connecting rod of a large industrial engine. The jack has a main body within which a piston shaft is reciprocatingly received. The adaptor has a main body in the form of a plate member, and the plate member has opposed faces. One of the faces has a safety rod device extending therefrom and the opposed face has a plurality of upstanding rod engaging pins extending therefrom in opposition to the safety rod device. The marginal free end of the piston shaft and the safety rod device telescopingly engage one another in a removable and slidable manner while the upstanding pins have opposed ends, with one end being affixed to the plate member and the other end freely extending therefrom so that the pins are received within bolt holes of the rod end. The pins are opposed to the mount means. The plate member, the pins, and the mount member are arranged to be free of the crankshaft journal as the rod end is engaged and lifted.

3 Claims, 2 Drawing Sheets

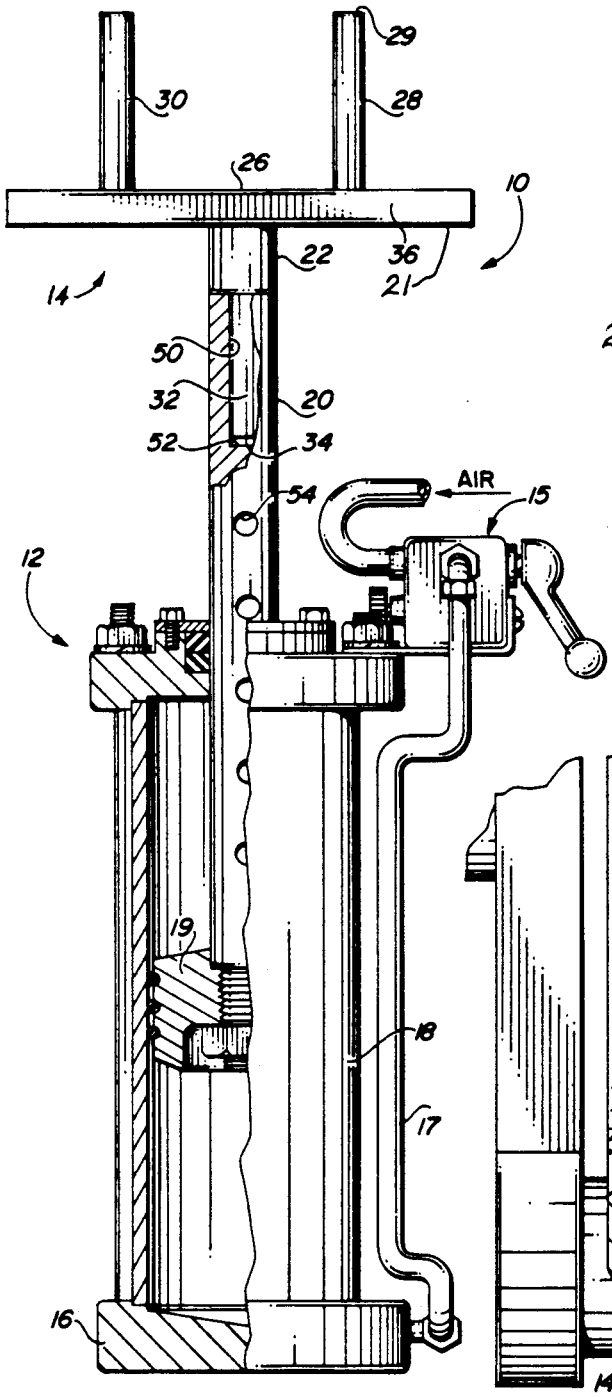
FIG. 1
FIG. 2
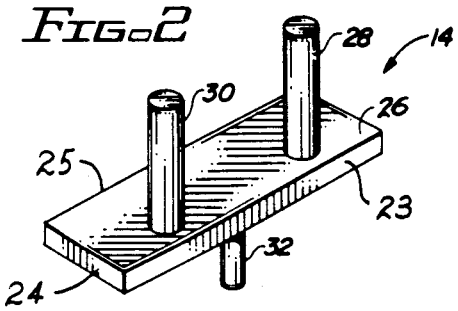
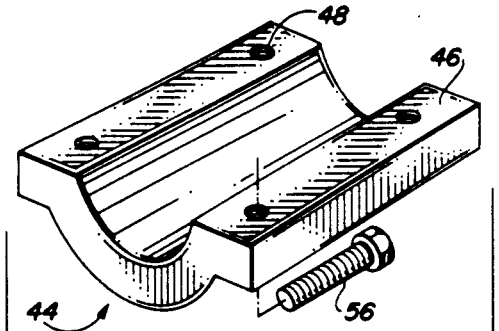
FIG. 3A
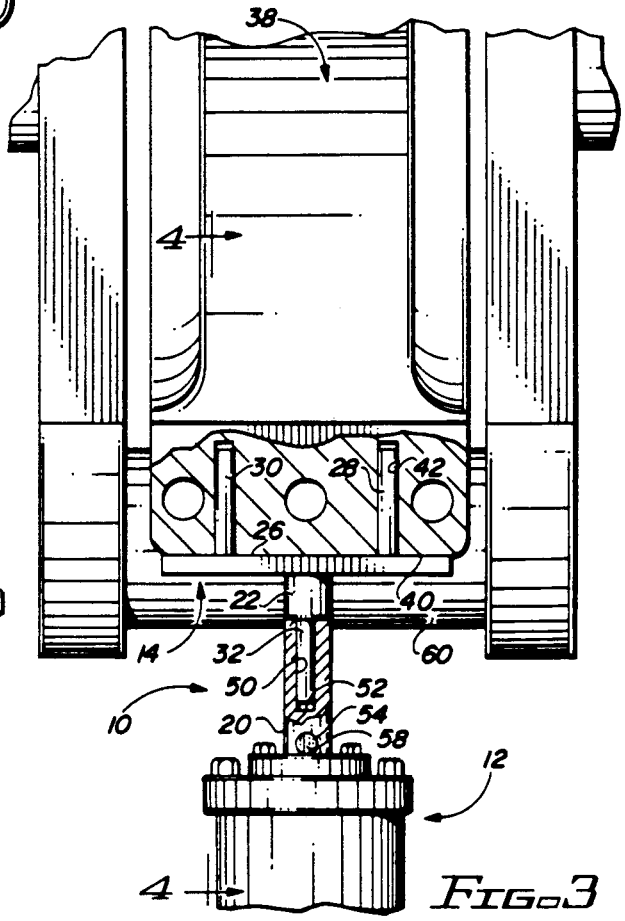
FIG. 3

PNEUMATIC BEARING JACK AND ADAPTORS

BACKGROUND OF THE DISCLOSURE

This invention discloses a lifting jack and adaptor combination for use in lifting and lowering a piston rod, such as a connecting rod or master rod, clear of the crankshaft journal of an industrial engine in a safe and novel manner. Lifting jacks are well known in the prior art and are hydraulically, pneumatically, or mechanically actuated. The present invention is used in combination with a lifting jack for positive engagement with the end of the piston rod after the rod cap has been removed therefrom. This enables the piston rod to be positively controlled and elevated to a sufficient height to enable the crankshaft piston rod bearing to be removed and replaced.

The master rod of a large industrial engine is extremely heavy and cannot safely be lifted and held elevated by one man. In the past, various levers and pry bars have been used for forcing the rod end, along with the piston, away from the crankshaft journal and consequently there is always the danger that the heavy piston and rod will slip and the rod end fall and mangle or sever the mechanic's hand. The present invention overcomes this unsafe practice by the combination of a special adaptor and lifting jack made especially for engaging and lifting the end of the piston rod in a new and unobvious manner. The term "piston rod", as claimed herein includes the master rod as well as the piston rod of a large industrial internal combustion engine of the reciprocating type.

SUMMARY OF THE INVENTION

Method and apparatus of replacing the piston rod bearing in a large industrial engine of the type having a replaceable bearing at a crankshaft journal thereof to which a rod end and cap are attached in journaled relationship. The method of this invention is carried out by removing the rod bolts and bearing cap from the rod end and thereby exposing the crankshaft and the face of the rod end; and thereafter using an adaptor having a plurality of upstanding pins affixed thereto that are of a size and configuration to be received within the rod bolt holes.

The adaptor is mounted at the upper end of the jack shaft and both the jack and adaptor is placed within the engine case in underlying relationship respective to the rod end. The upstanding pins of the adaptor is received within the bolt holes of the rod end, the rod and the piston are elevated clear of the engine crankshaft journal by extending the jack shaft and thereby force the rod away from the crankshaft an amount to gain access to the bearing.

This enables the bearing to be removed from the shaft while the heavy rod and piston are securely elevated. The old bearing is replaced with a new bearing; and then the rod and piston are lowered back into operative position. The rod and cap are next reassembled, and then the adaptor and jack are removed from the interior of the engine.

A primary object of this invention is to provide method and apparatus for positively controlling the elevation of a piston rod of a large industrial engine.

Another object of the present invention is the provision of the combination of a jack apparatus and engine piston rod adaptor for securely capturing and moving a piston rod of a large engine.

A still further object of this invention is the improvement of a jack and adaptor device for enabling the bearing of a piston rod to be safely replaced while the adaptor is mounted at the upper end of the jack shaft where it holds the rod and piston elevated and clear of the engine shaft journal.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

BRIEF DESCRIPTION OF THE DRAWINGS

FIG. 1 is a part cross-sectional, side elevational view of a lifting jack and adaptor made in accordance with the present invention;

FIG. 2 is a perspective view of part of the apparatus disclosed in FIG. 1;

FIG. 3 is a reduced, broken, part cross-sectional, side elevational view showing the bearing jack and adaptor of FIG. 1 in operation;

FIG. 3A is a perspective view of a rod end cap that has been removed from the master rod of FIG. 3;

DETAILED DESCRIPTION OF THE PREFERRED EMBODIMENT

Figure 4:
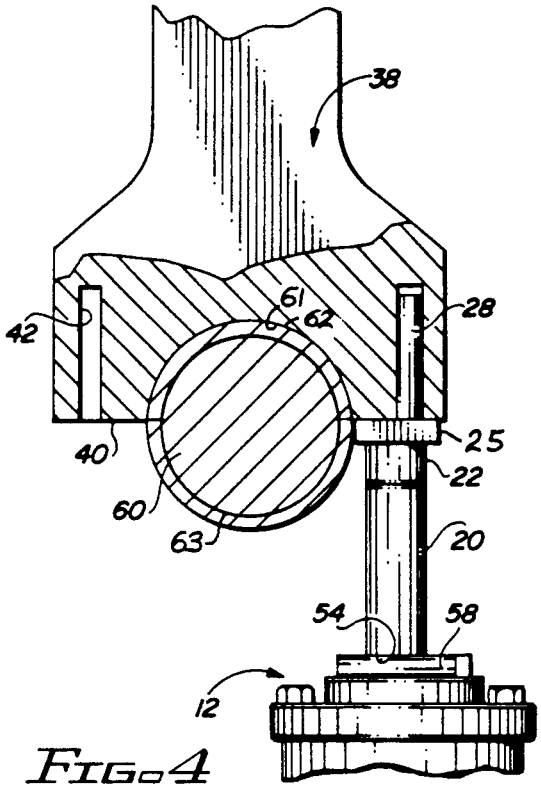
FIG. 4 is a broken, part cross-sectional view taken along line 4—4 of FIG. 3.
Figure 5:
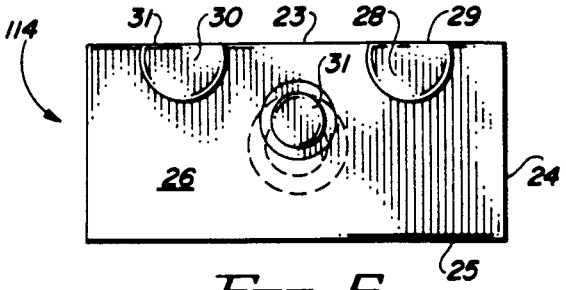
FIG. 5 is a top, plan view of an alternant embodiment of the present invention.
Figure 6:
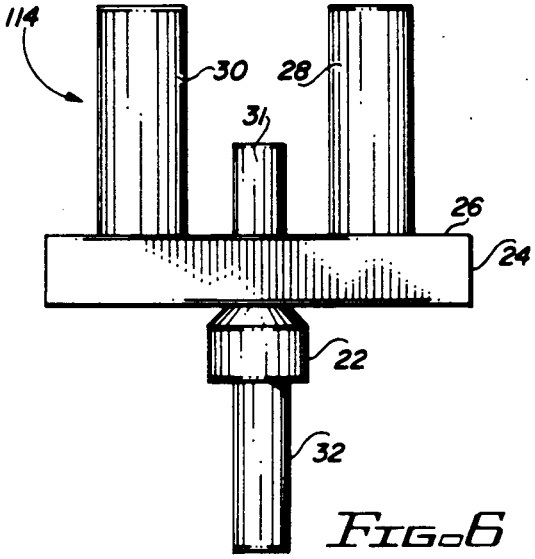
FIG. 6 is a side elevational view of the adaptor disclosed in FIG. 5.

In the figures of the drawings, there is disclosed a pneumatic bearing jack and adaptor combination 10 made especially for use in conjunction with heavy industrial engines. A pneumatic jack 12 is arranged for controllably lifting and lowering a novel adaptor 14. The jack 12 can be pneumatically, hydraulically, or mechanically actuated, as desired.

The jack 12 of FIG. 1 has a base 16 which supports one end of a fluid conduit 17. Barrel 18 reciprocatingly encloses a piston 19 having the illustrated seals thereon. A four way control valve 15 regulates the flow of fluid through the conduit 17, thereby controlling the pressure exerted against the lower face of jack piston 19. Jack shaft 20 is reciprocated by the jack piston 19.

The adaptor 14 of this invention can be used in conjunction with a Cooper Bessmer GMV type engine, for example. In FIGS. 1–4, the adaptor 14 has a lower face 21 and a boss 22 is rigidly affixed to the lower face thereof. Opposed ends 24 of a rectangular platform define an upwardly directed adaptor face 26 that is opposed to the lower face 21. Upright pins 28, 30 have a free terminal end 29, and the opposed ends thereof are affixed to the upper face 26 of the adaptor 14. Adaptor extension 32 downwardly depends from the aforementioned boss 22 and is telescopingly received within the upper marginal end of the jack shaft 20. Numeral 34 indicates the terminal end of the adaptor extension. Opposed, longitudinally extending sides 23 and 25 are arranged in the manner of FIGS. 1, 2 and 4 so that the adaptor plate member does not contact and mar the engine shaft journal.

Master rod 38 terminates in a lower face 40 into which the illustrated spaced counterbores 42 extend. Rod cap 44 has a face 46 which can abuttingly engage face 40, with the drilled holes 48 being aligned with the counterbores 42, when the end of the rod 38 and the cap 44 are assembled.

The jack shaft 20 has an axial counterbore 50 formed in the marginal terminal end thereof that ends at the bottom 52 and is of a size for telescopingly receives the end 34 of the adaptor extension 32. Numeral 54 indicates one of a plurality of spaced apart lateral holes drilled through the jack shaft for receiving a safety dial pin therein to assure that the jack cannot be lowered inadvertently. Numeral 56 is a bolt for securing the rod cap 44 to the end of the piston rod 38 in a known manner. Numeral 58 indicates the before mentioned pin inserted through the hole 54 in the jack shaft 20 for safety.

FIGS. 5 to 8 illustrate alternate embodiments 114 and 214 of the present invention wherein like or similar numerals refer to like or similar elements found in FIGS. 1–4. The second embodiment 114 can be used in conjunction with a Cooper Bessmer JS8 type engine. In the second embodiment of FIGS. 5 and 6, the pins 28, 30 and 31 are perpendicularly arranged respective to face 26 of the adaptor 114. A longitudinal, segmented portion has been removed from the pins 28, 30 thereby leaving a flat adjacent to edge portion 23 to enable the side 23 of the adaptor to be placed near the crankshaft in proper alignment with the face 40 found at the end of the piston rod 38. Member 31 is attached to face 26 and is disposed parallel respective to members 28 and 30. The adaptor extension 32 and boss 22 cooperate with the jack shaft in the before described manner of the first embodiment.

Figure 7:
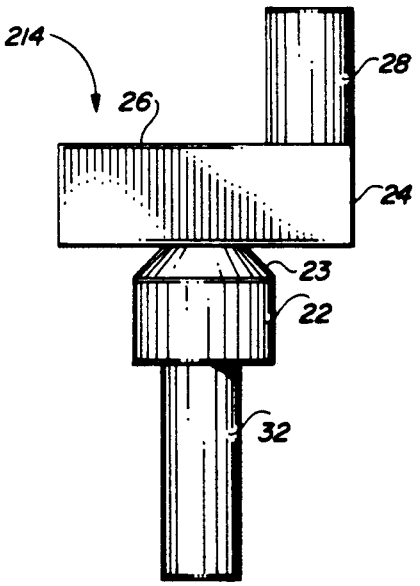
FIG. 7 is a side elevational view of another embodiment of the present invention; and, FIG. 8 is an end view of the apparatus disclosed in FIG. 7.
Figure 8:
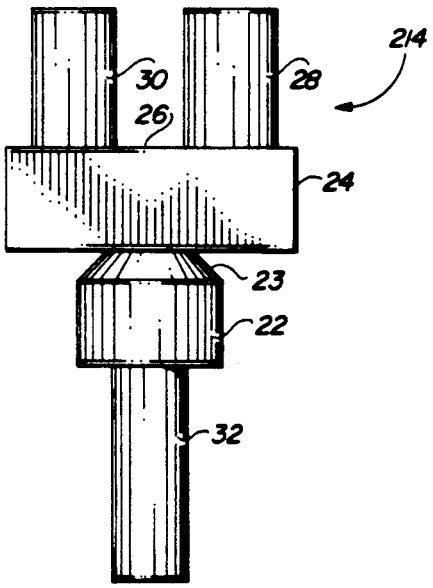

The third embodiment of the invention is set forth in FIGS. 7 and 8, and is for use in conjunction with the end of a piston rod of a White Superior GT-825 type engine. In FIGS. 7 and 8, the pins 28, 30 are cylindrical and the outer surface thereof is placed adjacent to the vertical side 24 of the plate member in aligment therewith. The face 26 has a substantially square configuration, with the boss 22 being centered and extending from the plate member in opposition to the pins 28, 30.

In operation, the inspection holes and entrance covers (not shown) are removed from the sides of the industrial engine being overhauled, and then the bearing cap 44 is removed in the usual manner, leaving the piston rod end resting on the crankshaft journal 62. The proper adaptor 14, 114, or 214 is selected and the extension 32 thereof is placed within the counterbore 50 of the jack shaft 20. Next the pneumatic jack is elevated into the illustrated position of FIGS. 3 and 4, with the upstanding guide pins 28, 30 being received within the counterbores 42 located at the end 40 of the connecting rod.

This assembly provides an extremely stable combination of elements for the reason that the flat base of jack bears against the floor of the engine and is therefore stable, while the adaptor is positively engaged in captured relationship with respect to the end 40 of the piston rod. Extension of the jack shaft 20 places everything in compression as the engine piston and piston rod assembly therefor are moved upwardly away from the shaft journal, thereby elevating the bearing 62 clear of the surface 63 of the crankshaft journal 60 in a controlled and stable manner.

When sufficient clearance exists between the piston rod surface 61, bearing 62, and the crankshaft journal 63, the bearing 62 is removed and a new one installed in its place. At the same time, a new bearing is provided for the bearing cap 44, and thereafter, the jack is used for carefully lowering the piston rod back into proper seated position, whereupon the adaptor and jack is removed, and the cap is then reassembled to the end of the connecting rod, and then the bolts 56 properly made up.

The adaptor apparatus of the present invention, in combination with a large industrial engine and a modified jack, provides a new combination of elements as well as a new method of replacing a master rod bearing or connecting rod bearing on a crankshaft journal. The method of the present invention is carried out as follows:

In a large industrial engine of the type having a replaceable bearing at a crankshaft journal thereof to which a piston rod end and cap is attached in journaled relationship, there being access holes in the sides of the engine block to enable access to the piston rod cap the rod bolts and bearing cap were removed from the rod end to thereby expose the crankshaft journal and the face of the piston rod end.

An adaptor 14, 114, or 214 was selected, each having a plurality of upstanding pins affixed thereto that are of a size to be received within the piston rod bolt holes. The adaptor extension 32 was mounted within the upper marginal end of the jack shaft, and the jack and adaptor were then securely placed within the engine block in underlying aligned relationship respective to the piston rod end. Next, the upstanding pins of the adaptor were telescoped into the counterbores 42 of the piston rod end as the jack shaft was extended to thereby lift the piston rod away from the crankshaft an amount to gain access to the bearing located between the rod and the journal or throw of the crankshaft.

This sequence of events made removing the bearing from the shaft safe and easy; and, it also made replacing the bearing unusually safe and efficient. After reassembling the rod, bearing, and cap, the adaptor and jack were removed from the interior of the engine thereby providing a safe method of replacing a piston rod bearing in a large industrial engine.

I claim:

1. In a large internal combustion engine and a jack, wherein the large engine has a piston rod with a journaled end, the journaled end of the rod has a face with bolt holes formed therein; the combination with said rod and jack of an improved adaptor that is interposed between the jack and the journaled end of the piston rod;

said jack has a main body and a piston shaft reciprocatingly received therein and extending therefrom, said adaptor has a main body in the form of a plate member, said plate member has opposed sides, one side of said plate member has an extension member affixed thereto and extending therefrom and the other side of said plate member has a plurality of upstanding rod engaging pins affixed thereto and extending therefrom in opposition to said extension member;

the marginal free end of the piston shaft and the extension member of said adaptor telescopingly engage one another in a removable and slidable manner; said extension member has a boss adjacent said plate member that is seated on the terminal end of the piston shaft, and the free marginal end thereof is received within a counterbore formed within the marginal terminal end of the shaft; said upstanding pins have opposed ends with one end being affixed to the plate member and the other end freely extending therefrom; said upstanding pins have a free marginal end received within the bolt holes of the rod journaled end, said other side of said plate member engages the face of the rod end; said upstanding pins are equally spaced from said extension member;

whereby, the plate member and the upstanding pins are free of the crankshaft journal as the rod end is engaged and lifted from the engine crankshaft by said adaptor and said jack.

2. In combination with a large internal combustion engine and a jack, wherein the large engine has a piston rod with a journaled end connected to the shaft of the engine, and the journaled end of the rod is opposed to a piston and has a face with bolt holes formed perpendicular therethrough; an improved adaptor;

said jack has a piston receiving cylinder, a piston shaft reciprocatingly received within said cylinder and extending therefrom; said adaptor has a main body in the form of a plate member and includes opposed sides, one side of said plate member has an extension member affixed thereto and extending therefrom towards said jack cylinder and the other side of said plate member has a plurality of upstanding piston rod engaging pins affixed thereto and extending towards the piston rod in opposition to said extension member;

the jack piston shaft has a marginal free end that the extension member of said adaptor telescopingly engages in a removable and slidable manner; opposed ends on the upstanding pins, with one end thereof being affixed to said plate member and the other end thereof freely extending therefrom; said upstanding pins have a free marginal end received within the bolt holes of the rod journaled end, said other side of said plate member engages the face of the rod end;

said upstanding pins are equally spaced from said extension member; said plate member and said upstanding pins are arranged respective to the rod end and jack to be free of the crankshaft journal as the rod end is engaged and lifted by said adaptor; a boss on said extension member that is seated on the end of the piston shaft, and the free marginal end thereof is received within a counterbore formed in the marginal terminal end of the jack shaft.

3. In combination with a large internal combustion engine and a jack, wherein the large engine has a piston rod, the rod has a journaled end opposed to a piston and has bolt holes formed therethrough for bolting a rod cap on said journaled end; an improved adaptor for being interposed between the jack and the journaled end of the piston rod;

the journaled end of the piston rod has a face adapted to receive the rod cap, bolt holes extending through the face of the piston rod; said jack has a main body and a piston shaft reciprocatingly received therein and extending therefrom, said adaptor has a main body with opposed sides, one of the opposed sides has an extension member affixed thereto and extending therefrom from and the other of the opposed sides has a plurality of upstanding rod engaging pins affixed thereto and extending therefrom in opposition to said extension member;

the marginal free end of the jack piston shaft and the marginal free end of the extension member of said adaptor telescopingly engage one another in a removable and slidable manner; said upstanding pins having opposed ends with one end being affixed to the plate member and the other end freely extending therefrom; said upstanding pins are positioned with the free marginal ends thereof received within the bolt holes of the rod journaled end, with said other side of said plate member engages the face of the rod end.

* * * * *